US006543519B2

(12) United States Patent
Pleschiutschnigg et al.

(10) Patent No.: US 6,543,519 B2
(45) Date of Patent: Apr. 8, 2003

(54) METHOD AND DEVICE FOR THERMAL CONTROL OF A CONTINUOUS CASTING MOLD

(75) Inventors: Fritz-Peter Pleschiutschnigg, Duisburg (DE); Stephan Feldhaus, Düsseldorf (DE); Jürgen Friedrich, Mülheim an der Ruhr (DE); Uwe Kopfstedt, Meerbusch (DE); Lothar Parschat, Ratingen (DE); Werner Rahmfeld, Mülheim an der Rjuhr (DE); Dieter Stalleicken, Duisburg (DE); Axel Weyer, Wuppertal (DE); Erwin Wosch, Stolberg (DE); Michael Vonderbank, Xanten (DE)

(73) Assignee: SMS Demag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 09/841,374

(22) Filed: Apr. 24, 2001

(65) Prior Publication Data

US 2002/0020513 A1 Feb. 21, 2002

(30) Foreign Application Priority Data

Apr. 25, 2000 (DE) ..... 100 20 181

(51) Int. Cl.[7] ..... B22D 11/22
(52) U.S. Cl. ..... 164/455; 164/154.7; 164/485
(58) Field of Search ..... 164/455, 485, 164/443, 414, 154.7, 151.4

(56) References Cited

U.S. PATENT DOCUMENTS 3,783,937 A * 1/1974 Maurer ..... 164/128
6,179,041 B1 * 1/2001 Pleschiutschnigg ..... 164/452
6,299,071 B1 * 10/2001 Fiedrich ..... 237/8 R

* cited by examiner

*Primary Examiner*—Tom Dunn
*Assistant Examiner*—I.-H. Lin
(74) *Attorney, Agent, or Firm*—Sidley Austin Brown & Wood, LLP

(57) ABSTRACT

A method of controlling a hot face temperature of a copper plate of a mold for continuous casting of steel with variable casting rates and including:

providing a bypass line for connecting a mold water outlet with a mold water inlet for obtaining, at the mold water inlet a mixture of heated mold water and cooled mold water, which mixture is fed into the mold as a cooling water having a chageable temperature depending on casting conditions; providing, at the mold water outlet, a two-way valve connectable with the bypass line and a heat exchanger for cooling the heated mold water for distributing the heated mold water between the bypass line and the heat exchanger with; and control of the operation of the two-way valve in accordance with the exit water temperature to maintain a constant predetermined water temperature at the mold water outlet, whereby a constant hot face temperature is maintained.

1 Claim, 3 Drawing Sheets

Powder A, 1.4 d P
Powder B, 0.9 d P

V = 6000 l/min
VC = 6 m/min
W = 1200 mm
P = 12 bar
$W_{max}$ = 1600 mm

METHOD AND DEVICE FOR THERMAL CONTROL OF A CONTINUOUS CASTING MOLD

BACKGROUND OF THE INVENTION

1. Field of the Invention

The present invention relates to a continuous casting mold.

2. Description of the Prior Art

The continuous casting molds known to the art, whether configured as multi-station molds such as, for example, the "twin roller" pursuant to a $19^{th}$ Century Bessemer patent, or as a single-station mold, are comprised of a copper wall, which is cooled from the back with water via a water distribution chamber.

The state of the art and its shortcomings (as depicted in FIG. 1), are illustrated in the following using the example of an oscillating single-station mold (1), whereby preferably steel using a SEN or submerged entry nozzle (2) and casting powder (3) or casting slag (3.1) is cast into slabs or ingots having a thickness of between 150 and 30 mm and a maximum width of up to of 3.300 mm at a casting velocity (4) of up to max. 15 m/min.

Conventionally, such a mold is supplied with water cooling of, for example, 4,000–8,000 L/min with a strand [casting] width (5) of 1,600 mm and at a pressure of between 5–15 bar, whereby said water cooling is constructed in such a manner that the water temperature $T^{M}_{in}$ at the mold inlet (6) is held constant independent of casting velocity (4), casting width (5), thickness of the copper plate (7), casting powder (3), casting slag (3.1), water pressure (9) and oscillation (12).

As casting velocity increases, the mold coolant water (10) accrues a higher temperature $T^{M}_{out}$ (11). The temperature difference (13) between the constant inlet temperature (16) and the variable outlet temperature (11) is a function of the aforementioned constraints. If, for example, the system is considered under the assumption that all constraints, save for casting velocity, are held constant, then, with increasing casting velocity from $VC_1$ (4.1) to $VC_2$ (4.2) the outlet temperature (11) or the temperature difference (13) and consequently the mold skin temperature (14), increases from $T_1$ (14.1) to $T_2$ (14.2) as does the energy under the energy lobe [sic] (15) from (15.1) to (15.2).

Consequently, with changing casting velocity (4) and with the variation in the aforementioned constraints, the 'hot-face' temperature (14) changes, resulting in constantly varying lubrication of the strand shell (16) and thermal flux (17) in the mold, whereby said variations in casting conditions result in perturbations of the casting process and in the surface of the strand.

Continuing with the description of the water circuit, the water then is cooled to a desired constant inlet temperature (6) in an output controllable heat exchanger (18) and the water is re-directed to the mold under a preset pressure (9) with the aid of a pump station (19). Moreover, at high casting velocities of 10–15 m/min, said water cooling system runs the risk of forming vapor films at the 'cold face' of the mold shell (20), because the vapor point at a preset pressure is exceeded the over-temperature in the thermal transfer region of the copper wall.

The heat exchanger (18) is cooled via a cooling tower (21) equipped with a pump station (21.1).

The object of the invention is to create a generic process and device which improve upon the mold operation and the continuous casting process.

SUMMARY OF THE INVENTION

The unanticipated solution that is not obvious to one skilled in the art is made clear by the characteristics. Pursuant to the invention, a mold cooling system is achieved in which the mold skin temperature 'hot face' (14) remains constant under varying casting conditions and is maintained under control whereby constant conditions are established for the casting powder (3) and the casting slag (3.1) wherein an unperturbed thermal flux (17) is assured over the width of the casting without the formation of a vapor layer (Leidenfrost effect).

BRIEF DESCRIPTION OF THE DRAWINGS

The state of the art and the inventive solution is depicted in FIGS. 1 to 3 using the example of an oscillating thin-ingot mold with casting velocities of up to 15 m/min.

DETAILED DESCRIPTION OF THE PREFERRED EMBODIMENT

Figure 1A:
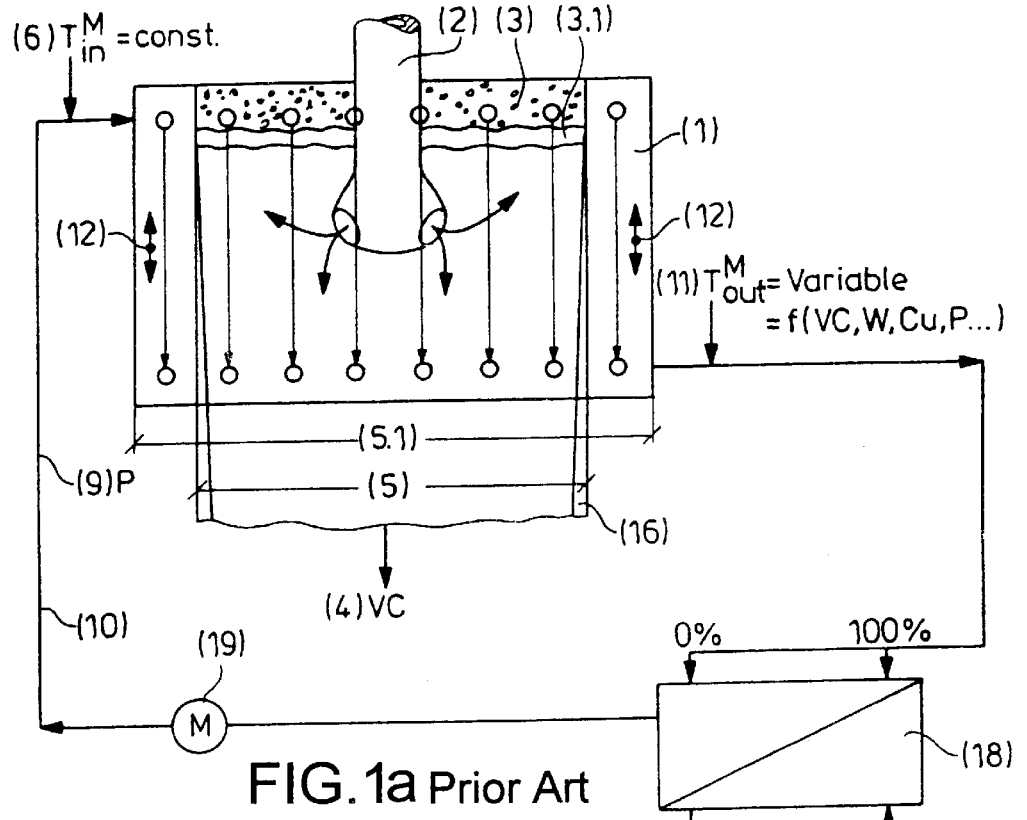
FIG. 1a Prior Art
FIG. 1 depicts the state of the art and has already been described in detail.
Figure 1B:
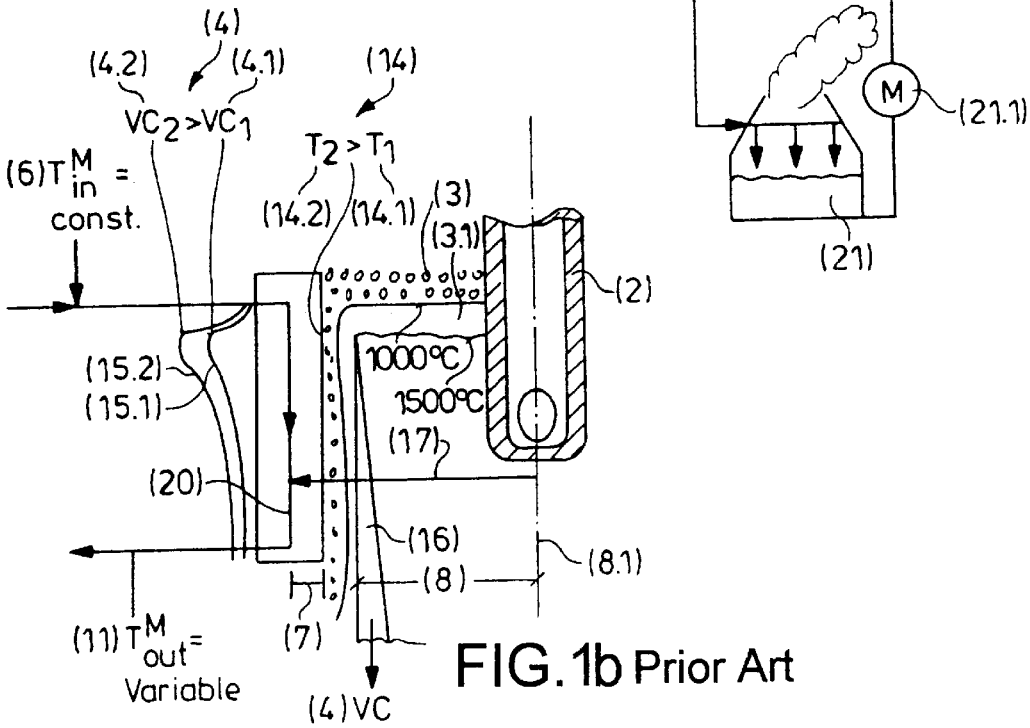
FIG. 1b Prior Art
Figure 2A:
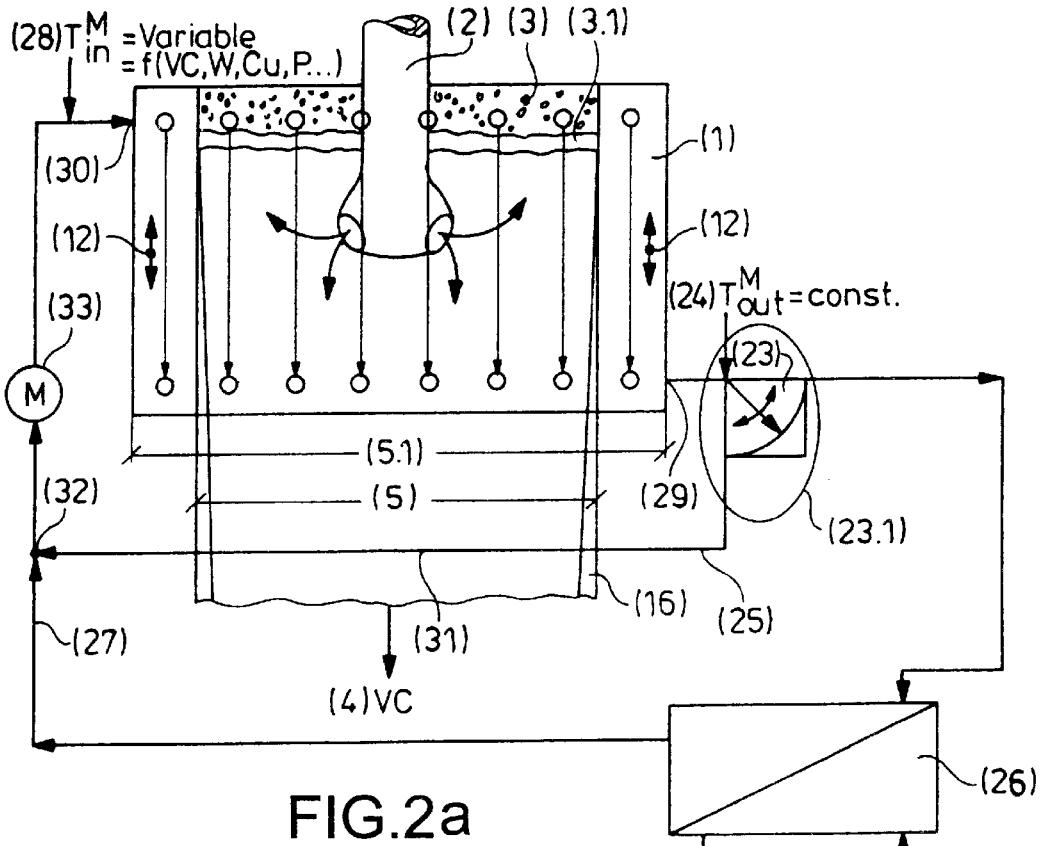
FIG. 2 depicts the solution pursuant to the invention using the example of a thin-ingot using casting rates of up to 15 m/in viewed in cross-section, subdrawing 2*a*) and laterally, subdrawing 2*b*).
Figure 2B:
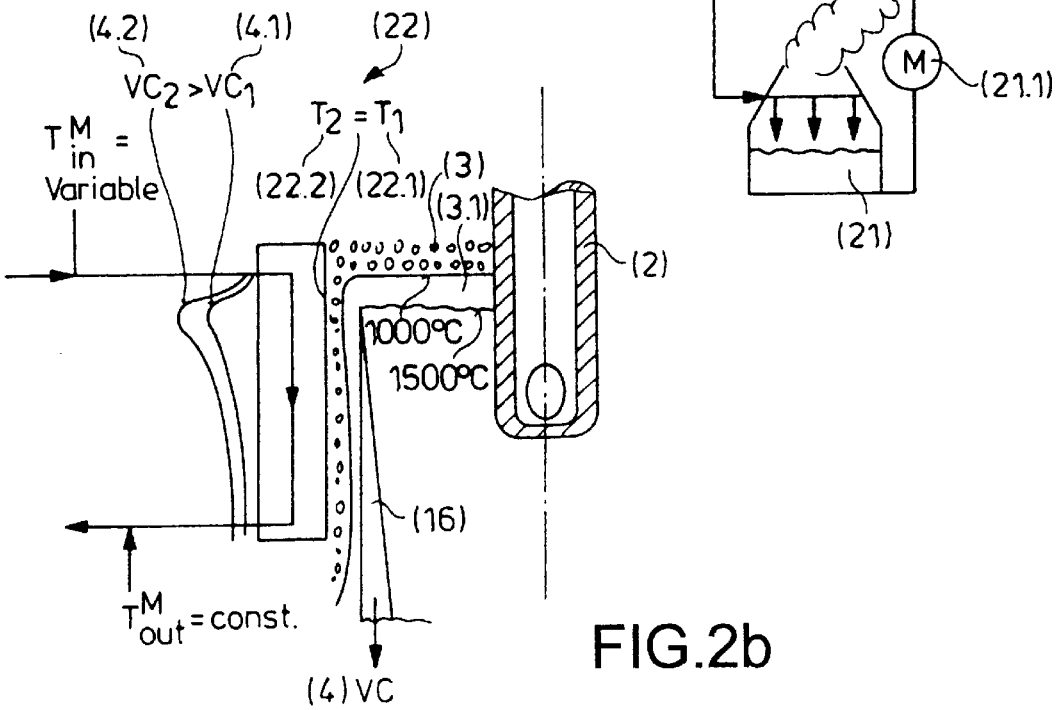

FIG. 2 depicts the inventive solution for mold cooling that assures a constant 'hot face' temperature (22) at varying casting velocities (4.1) and (4.2) and/or other parameters, such as:

ingot width (5), thickness of the copper plate (7), casting powder (3), casting slag (3.1), water pressure, and oscillation (12).

The essential feature of the invention is comprised in that a two-way valve (23) is situated at the mold cooling water outlet of the mold and that said valve, with the aid of a temperature sensor, that is set to a controlled constant temperature (24), the water distribution between hot mold water (25) and cooled mold water (27) (via a heat exchanger (26)) is provided whereby, for example, the outlet temperature (24) remains constant with changing casting velocities (4).

With this reversal; that is, from the entry side to the exit side of the mold, of the water temperature to be held constant, the water entry temperature (28) constantly changes with changing casting parameters. Furthermore, it is essential that the pup-bypass (31) arranged between the mold water outlet (29) and the mold water inlet (30) is kept as short as possible and that said bypass together with the mold circuit (27) is conducted via the heat exchanger (26) and converges immediately upstream of the mold water inlet (30) at a junction node (32). A pump station (33) is then arranged between said bypass junction (31) and the mold inlet (30).

Figure 3A:
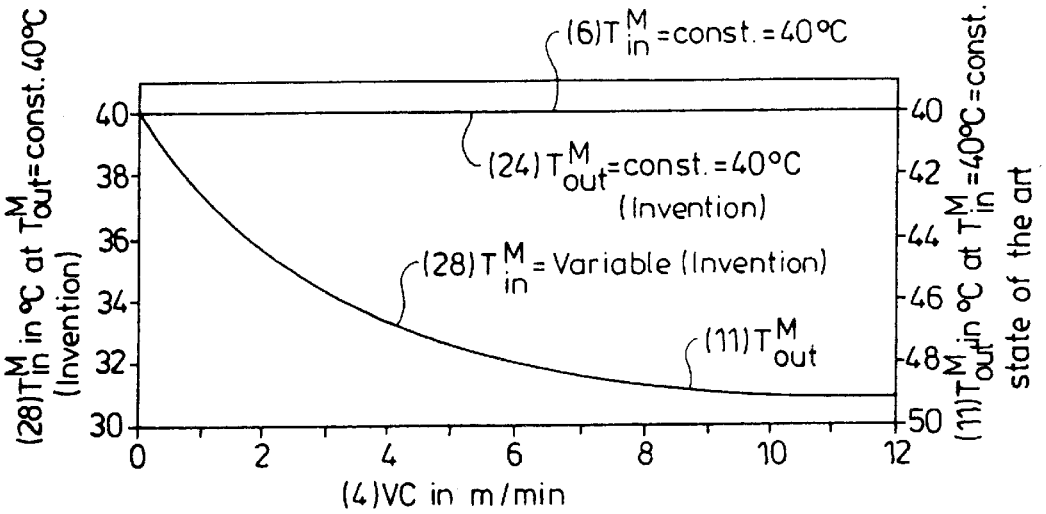
FIG. 3 depicts in subdrawing 3*a*) both the course of the inlet temperature of the variable water inlet temperature as a function of casting rate at constant outlet temperature (inventive) and the water exit temperature as a function of casting rate at constant inlet temperature (state of the art), and Subdrawing 3*b*) depicts for the inventive solution the variable entry temperature at a constant exit temperature of 40 or 30° C. in dependence on the thickness of the copper plate for two different casting powders, A and B.
Figure 3B:
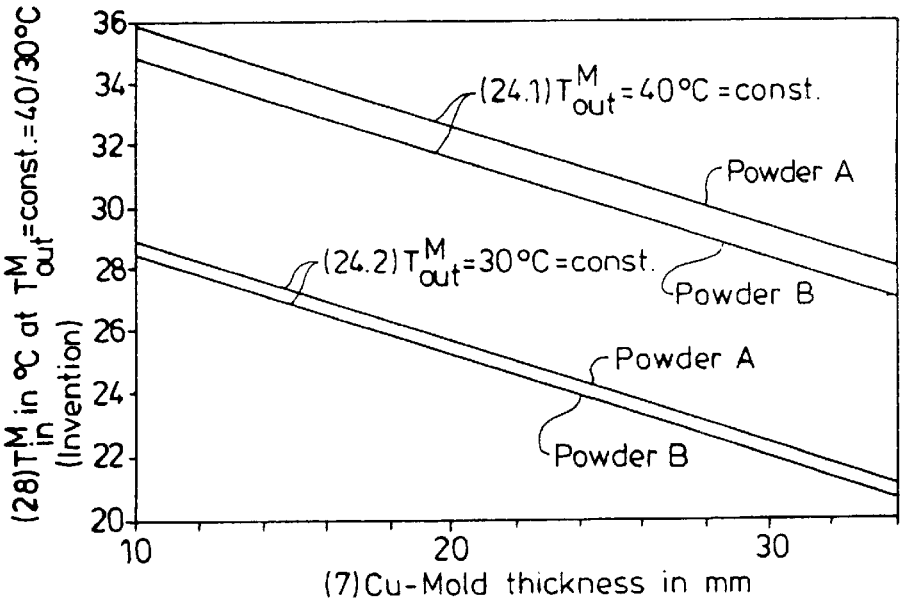

FIG. 3*a*) depicts the function of the inventive solution; namely, the water inlet temperature $T^M_{in}$ (28) over casting velocity (4) at constant outlet temperature $T^M_{out}$=constant= 40° C. (24). Said function shows that the 'hot face' temperature (22) sinks at a constant rate with changing casting rate.

Conversely, subdrawing 3*a*) depicts the completely alternative situation of the cooling systems known in the art, wherein the outlet temperature (11) and consequently the hot-face temperature (14) increases with casting velocity at constant inlet temperature (6), whereby in the comparison, the aforestated disadvantages are easily recognized.

Subdrawing 3*b*) depicts the differing inlet temperatures (28) for different thicknesses of copper plate (7) for instances of constant outlet temperatures (24) of 40° C. (24.1) and 30° C. (24.2) and for casting powders A or B at constant process parameters, such as:

casting rate of 6 m/min.

casting width of 1,200 mm and max. casting width of 1,600 mm and pressure of 12 bar and water flow rated of 6,000 L/min.

In the case of the inventive solution, the function shows that for constant outlet temperatures (24.1) and (24.2) or hot-face temperatures (22) and changing copper plate thickness (7) and for casting powders A and B, the inlet temperature $T^M_{in}$ (28) is functionally changed.

The invention makes obvious the fact that with the introduction of a thermostat (24) on the mold water outlet side for stabilization/control of a two-way valve (23), the hot face temperature of the mold plate can be maintained constant independent of the casting conditions, wherein said solution assures that the thermal flux over the width of the mold remains undisturbed and constant, the service life of the mold plates is more controlled by their skin temperature (22), and optimum conditions for strand surface are present even at high casting velocities of up to 15 m/min.

What is claimed is:

1. A method of controlling a hot face temperature of a copper plate of a mold for continuous casting of steel with variable casting rates, the method comprising the steps of:

providing a bypass line for connecting a mold water outlet with a mold water inlet for obtaining, at the mold water inlet, a mixture of heated mold water and cooled mold water, which mixture is fed into the mold as a cooling water having a changeable temperature depending on casting conditions;

providing, at the mold water outlet, a two-way valve connectable with the bypass line and means for cooling the heated mold water for distributing the heated mold water between the bypass line and the cooling means; and controlling operation of the two-way valve in accordance with exit water temperature so that a constant predetermined water temperature is maintained at the mold water outlet, whereby a constant hot face temperature is maintained.

* * * * *